US010683589B2

(12) United States Patent
Okamoto et al.

(10) Patent No.: US 10,683,589 B2
(45) Date of Patent: Jun. 16, 2020

(54) POLYETHERIMIDE-BASED FIBER, METHOD FOR MANUFACTURING SAME, AND FIBER STRUCTURE CONTAINING SAME

(71) Applicant: KURARAY CO., LTD., Kurashiki-shi (JP)

(72) Inventors: Tetsuya Okamoto, Kurashiki (JP); Akihiro Uehata, Kurashiki (JP); Satoshi Katsuya, Kurashiki (JP)

(73) Assignee: KURARAY CO., LTD., Kurashiki-shi (JP)

( * ) Notice: Subject to any disclaimer, the term of this patent is extended or adjusted under 35 U.S.C. 154(b) by 322 days.

(21) Appl. No.: 15/468,151

(22) Filed: Mar. 24, 2017

(65) Prior Publication Data

US 2017/0191191 A1 Jul. 6, 2017

Related U.S. Application Data

(63) Continuation of application No. PCT/JP2015/077335, filed on Sep. 28, 2015.

(30) Foreign Application Priority Data

Sep. 29, 2014 (JP) ..... 2014-198284

(51) Int. Cl.
*D01F 6/78* (2006.01)
*D04H 1/4326* (2012.01)
(Continued)

(52) U.S. Cl.
CPC ..... *D01F 6/78* (2013.01); *D01D 1/02* (2013.01); *D01D 5/08* (2013.01); *D01F 1/04* (2013.01);
(Continued)

(58) Field of Classification Search
CPC ..... C08L 2666/20; D01F 6/74; D01F 1/09; D04H 1/551; D04H 1/46; Y10T 442/696; Y10T 428/2918
(Continued)

(56) References Cited

U.S. PATENT DOCUMENTS 9,518,341 B2 12/2016 Endo et al.
2005/0092971 A1 5/2005 Easter
(Continued)

FOREIGN PATENT DOCUMENTS

JP 8-322707 12/1996
JP 11-1872 1/1999
(Continued)

OTHER PUBLICATIONS

Addcon World 2001 Conference Proceedings, Rapra Technology Ltd. (Year: 2001).*
(Continued)

*Primary Examiner* — Matthew D Matzek
(74) *Attorney, Agent, or Firm* — Oblon, McClelland, Maier & Neustadt, L.L.P.

(57) ABSTRACT

Provided is a polyetherimide-based fiber containing a polyetherimide resin and carbon black dispersed in the resin, wherein the content of the carbon black is 0.03 wt % or greater; the carbon black has a primary particle number-mean particle size of from 30 nm to 500 nm; and the fiber has a weight reduction rate of less than 0.5% around the glass transition point (Tg) of the polyetherimide resin, where
(Continued)

the weight reduction rate is defined by a following formula (1).

$$\text{Weight reduction rate (\%)}=\{[(\text{fiber weight at temperature } T1)-(\text{fiber weight at temperature } T2)]/(\text{fiber weight at temperature } T1)\}\times 100 \quad (1)$$

Where T1 denotes a temperature (Tg−15° C.) that is 15° C. lower than the glass transition point (glass transition temperature) of the polyetherimide resin, and T2 denotes a temperature (Tg+25° C.) that is 25° C. higher than the glass transition point.

6 Claims, 3 Drawing Sheets

(51) Int. Cl.

| | |
|---|---|
| ***D04H 1/46*** | (2012.01) |
| ***D01F 1/04*** | (2006.01) |
| ***D01F 6/74*** | (2006.01) |
| ***D01D 1/02*** | (2006.01) |
| ***D01D 5/08*** | (2006.01) |

(52) U.S. Cl.
CPC ..... *D01F 6/74* (2013.01); *D04H 1/4326* (2013.01); *D04H 1/46* (2013.01); *D10B 2331/06* (2013.01)

(58) Field of Classification Search
USPC ..... 428/357, 364, 367, 372, 402; 977/773, 977/778, 779, 785; 442/400, 414, 417; 264/638, 639
See application file for complete search history.

(56) References Cited

U.S. PATENT DOCUMENTS

| | | | | |
|---|---|---|---|---|
| 2008/0139065 | A1* | 6/2008 | Amarasekera | C08L 67/02 442/189 |
| 2009/0247039 | A1 | 10/2009 | Amarasekera et al. | |
| 2012/0015184 | A1* | 1/2012 | Endo | D01F 6/74 428/364 |
| 2015/0069654 | A1 | 3/2015 | Endo et al. | |
| 2015/0315725 | A1 | 11/2015 | Uehata et al. | |
| 2016/0145782 | A1* | 5/2016 | Sasaki | D04H 3/16 428/332 |

FOREIGN PATENT DOCUMENTS

| | | | | |
|---|---|---|---|---|
| JP | 2002-241562 | A | 8/2002 | |
| JP | 2007-23408 | | 2/2007 | |
| JP | 2012-41644 | | 3/2012 | |
| WO | WO 2010/109962 | A1 | 9/2010 | |
| WO | WO 2014/112423 | A1 | 7/2014 | |
| WO | WO-2014208671 | A1 * | 12/2014 | D04H 3/16 |

OTHER PUBLICATIONS

Extended European Search Report dated Apr. 13, 2018 in Patent Application No. 15846045.1, 7 pages.
International Search Report dated Dec. 28, 2015 in PCT/JP2015/077335, filed on Sep. 28, 2015.
Japanese Office Action dated Jul. 30, 2019 in Japanese Patent Application No. 2016-552018 (with unedited computer generated English translation), 8 pages.
Notice of Reasons for Refusal dated Nov. 5, 2019 in corresponding Japanese Patent Application No. 2016-552018 with machine English translation, 4 pages.

* cited by examiner

POLYETHERIMIDE-BASED FIBER, METHOD FOR MANUFACTURING SAME, AND FIBER STRUCTURE CONTAINING SAME

CROSS REFERENCE TO THE RELATED APPLICATIONS

This application is a continuation application, under 35 U.S.C. § 111(a), of international application No. PCT/JP2015/077335, filed Sep. 28, 2015, which claims priority to Japanese patent application No. 2014-198284, filed Sep. 29, 2014, the entire disclosure of which is herein incorporated by reference as a part of this application.

FIELD OF THE INVENTION

The present invention relates to a polyetherimide-based fiber containing carbon black dispersed in a polyetherimide resin, a production method thereof, and a fiber structure containing such fibers and having a certain light-blocking (shading) effect.

BACKGROUND OF THE INVENTION

Conventionally, fiber structures, such as a fabric, a mat (flocked fiber material), and a fiber reinforcing material, are used for the purpose of heat insulation, sound isolation, and other purposes in ordinary houses, and various establishments, such as hospitals, schools, and accommodations, and various transportation means (vehicles), such as cars, airplanes, and vessels. In another side, the components containing these fibers or fiber materials are desired to be formed from a fire retardant material.

Polyetherimide has excellent fire retardancy, and is known as a useful material as a fabric required for fire retardancy, or a material for a fiber reinforcing member. For example, Patent Document 1 (WO 2010/109962) describes a polyetherimide-based fiber having a shrinkage percentage under dry heat at 200° C. of 5% or less, and a heat resistant fabric containing the fibers. Patent Document 2 (JP Laid-open Patent Publication No. 2012-41644) describes a non-woven fabric containing amorphous polyetherimide-based fibers and a molded structure formed by heating the non-woven fabric to make all or a part of amorphous polyetherimide-based fibers to be fused. In Patent Documents 1 and 2, carbon black is described as one of the choices of the inorganic substances which may be contained in the amorphous polyetherimide-based fiber.

SUMMARY OF THE INVENTION

Although Patent Documents 1 and 2 describe carbon black as one of the choices of the inorganic substance added to polyetherimide-based fibers, these documents neither consider the conditions, such as the concrete addition amount and particle size, nor examine the effect of carbon black addition on the characteristic of a polyetherimide-based fiber at the time of heating.

Therefore, the object of the present invention is to provide a polyetherimide-based fiber containing carbon black dispersed in a polyetherimide resin, the fiber being capable of imparting a certain light-blocking effect to a fiber structure as well as capable of maintaining the characteristics as a fire retarding material; a production method thereof, and a fiber structure containing such fibers.

A first aspect of the present invention is a polyetherimide-based fiber containing a polyetherimide resin and carbon black dispersed in the resin. The fiber has a content of the carbon black of 0.03 wt % or greater. The carbon black has a primary particle number-mean particle size of from 30 nm to 500 nm. The fiber has a weight reduction rate of less than 0.5% around the glass transition point (Tg) of the polyetherimide resin. The weight reduction rate is defined by a following formula (1).

$$\text{Weight reduction rate (\%)}=\{[(\text{fiber weight at temperature } T1)-(\text{fiber weight at temperature } T2)]/(\text{fiber weight at temperature } T1)\}\times 100 \quad (1)$$

Where T1 denotes a temperature (Tg−15° C.) that is 15° C. lower than the glass transition point (glass transition temperature) of the polyetherimide resin, and T2 denotes a temperature (Tg+25° C.) that is 25° C. higher than the glass transition point.

It is preferable that the carbon black satisfies a ratio D/A of 80 or more, where "D" denotes a primary particle number-mean particle size of the carbon black as "D nm (nanometer)" and "A" denotes a content of carbon black in the fiber as "A wt % (% by weight)". The ratio D/A is more preferably from 100 to 2000, and still more preferably from 400 to 1000.

A second aspect of the present invention is a fiber structure containing the polyetherimide-based fibers according to the first aspect. The fiber structure preferably contains the polyetherimide-based fibers at a content of 30 wt % or greater. The fiber structure may be a sheet-shaped material containing 0.2 to 7.0 g/m$^2$ of carbon black, for example, and may be a fabric. This sheet-shaped material may be formed from a monolayer, or may be formed from a plurality of layers.

A third aspect of the present invention is a method for producing the polyetherimide-based fiber according to the first aspect. The method includes kneading carbon black into a polyetherimide resin to obtain a carbon black-kneaded resin, and melt-spinning the carbon black-kneaded resin to form a fiber.

In the production method of the polyetherimide-based fiber, the carbon black-kneading process may include: preparing a masterbatch in which carbon black is kneaded into a first polyetherimide resin, and kneading the masterbatch into a second polyetherimide resin.

In the above-mentioned method, the carbon black-kneading process may be carried out at a temperature of from 340° C. to 400° C. The melt-spinning process may be carried out at a temperature of from 340° C. to 430° C.

It should be noted that any combination of at least two constructions, disclosed in the appended claims and/or the specification should be construed as included within the scope of the present invention. In particular, any combination of two or more of the appended claims should be equally construed as included within the scope of the present invention.

According to the present invention, it is possible to provide a polyetherimide-based fiber being able to impart a certain light blocking effect to a fiber structure, while excelling in fire retardancy as well as preventing gas generation from the fiber under high temperature. The fiber structure containing such fibers is also excellent in fire retardancy while preventing gas generation under high temperature, so that such a fiber structure excels in safety in closed space, while achieving a desired light blocking effect.

DESCRIPTION OF THE EMBODIMENTS

Figure 1:
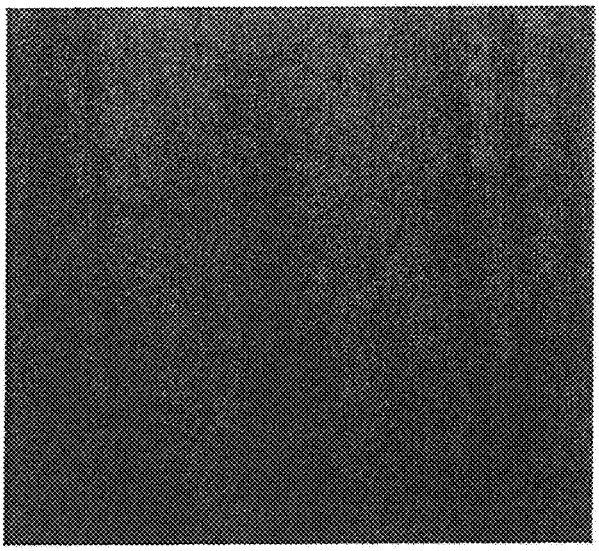
FIG. 1 is a photograph used for the light blocking effect evaluation test of the fabric obtained in Example 7 according to the present invention.

In some cases a fiber structure may be required to have a certain light blocking effect in order to shield sunlight or lighting or to reduce illumination. The inventors of the present invention found out a problem specific to chemical fibers containing carbon black, in which although such chemical fibers can give a light blocking effect to a fiber structure, such a fiber structure may have a problem when using as a fire retarding material under high temperature because of outgassing caused by gas generation from carbon black at high temperature. As a result of intensive studies to achieve the above object, the inventors of the present invention have found the followings. In a fiber structure including polyetherimide-based fibers, each containing a polyetherimide resin as a base material of the fiber and carbon black dispersed in the polyetherimide resin, where an outgassing amount due to gas generation from the fiber is controlled to be inhibited in a certain range around the glass transition point of a polyetherimide resin; such fibers can impart a certain light blocking effect to the fiber structure, and a fiber structure can be suitably used as a fire retarding material. Here, the term "light blocking effect" denotes a performance which reduces the amount of light transmission through a fiber structure depending on needs.

Hereinafter, the details of the present invention are further explained.

The polyetherimide-based fiber according to the present invention is a fiber containing a polyetherimide resin and carbon black dispersed in the above-mentioned resin. The polyetherimide-based fiber contains carbon black at a content of 0.03 wt % or more in the fiber, and has a controlled weight reduction rate of less than 0.5% around the glass transition point temperature (Tg) of the polyetherimide resin as defined by a following formula (1).

$$\text{Weight reduction rate (\%)}=\{[(\text{Fiber weight at temperature } T1)-\text{Fiber weight at temperature } T2)]/(\text{Fiber weight at temperature } T1)\}\times 100 \quad (1)$$

Where T1 denotes a temperature (Tg−15° C.) that is 15° C. lower than the glass transition point (glass transition temperature) of the polyetherimide resin, and T2 denotes a temperature (Tg+25° C.) that is 25° C. higher than the glass transition point.

In the fire retardant fiber, carbon black is kneaded into a resin containing a polyetherimide. Then, the fire retardant fiber can be produced by melt-spinning the resin. The fiber can be used for a fiber structure such as a fiber mat and a fabric (for example, a woven or knitted fabric and a non-woven fabric), or can be used as a material for a resin-molded article.

Polyetherimide Resin

The resin constituting the fiber according to the present invention includes a polyetherimide resin (called PEI resin). The polyetherimide resin is a polymer including an aliphatic, alicyclic, or aromatic ether unit and a cyclic imide as repeating units, and is not limited to a specific one as long as the polymer has melt formability. Moreover, the main chain of the polyetherimide resin also may include a structural unit, such as an aliphatic, alicyclic or aromatic ester unit and an oxycarbonyl unit, other than the cyclic imide and the ether unit within the range that the effect of the present invention is not deteriorated. The polyetherimide resin may be crystalline or amorphous, and preferably is an amorphous resin.

More concretely, as the polyetherimide resin to be suitably used, there may be mentioned a polymer including a unit of the following general formula. It should be noted that in the formula R1 is a divalent aromatic residue having 6 to 30 carbon atoms; R2 is a divalent organic group selected from the group consisting of an aromatic residue having 6 to 30 carbon atoms, an alkylene group having 2 to 20 carbon atoms, a cycloalkylene group having 2 to 20 carbon atoms, and a polydiorganosiloxane group in which a chain is terminated with an alkylene group having 2 to 8 carbon atoms.

Chem. 1

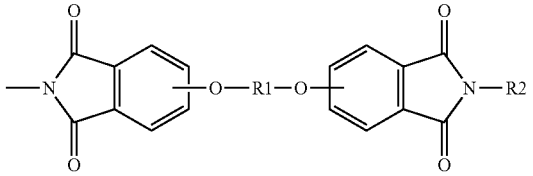

The preferable R1 and R2 include, for example, an aromatic residue and/or an alkylene group (for example, m=2 to 10) shown in the following formulae.

Chem. 2

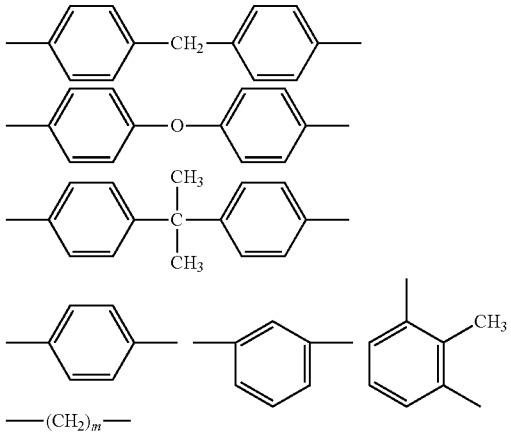

In the present invention, from the viewpoint of melt formability, and cost reduction, the preferable polyetherimide resin includes a condensate of 2,2-bis[4-(2,3-dicarboxyphenoxy)phenyl]propane dianhydride and m-phenylenediamine, having a structural unit shown by the following formula as a main constituent. Such a polyetherimide is available from SABIC Innovative Plastics Holding under the trademark of "ULTEM".

Chem. 3

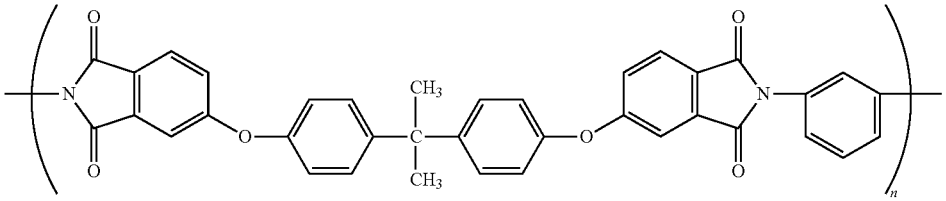

The molecular weight of the polyetherimide resin used in the present invention is not limited to a specific one. In taking the mechanical property, dimensional stability, and processability of the fibers formed from the polymer into consideration, the polyetherimide resin preferably has a melt viscosity of 5000 poise or lower measured at the temperature of 390° C. and the shear rate of 1200 $sec^{-1}$, and in view of this, the polyetherimide resin preferably has a weight-average molecular weight (Mw) of about 1000 to about 80000. Although it is desirable to use a resin having a large molecular weight because such a resin is excellent in heat-resisting property as well as capable of forming fibers with an improved tenacity, the resin preferably has an Mw of 10000 to 50000 in view of cost required for resin production and/or fiber forming.

If necessary, a polyetherimide resin can be used for the resin having a molecular weight distribution (Mw/Mn) of within the range between 1.0 and 2.5, preferably within the range between 1.0 and 2.4, and more preferably within the range between 1.0 and 2.3, which is the ratio of a weight-average molecular weight (Mw) and a number-average molecular weight (Mn).

The polyetherimide resin to be used may have a glass transition point of from 180° C. to 300° C.

The resin constituting a polyetherimide-based fiber may consist essentially of the above-mentioned polyetherimide resin, but the resin may also include other resin within the range that does not impair the effect of the present invention. The resin constituting the polyetherimide-based fiber used in the present invention may preferably contain a polymer having a unit shown by the above-mentioned general formula in the proportion of at least 50 mass % or greater, more preferably 80 mass % or greater, still more preferably 90 mass % or greater, and especially 95 mass % or greater. Moreover, the resin constituting a fiber may contain, for example, a heat stabilizer from a viewpoint of improving melt-spinning property of the resin.

Carbon Black

In the present invention, it is indispensable to control both particle size of carbon black and the content of the carbon black in the fiber.

Examples of the carbon black used in the present invention may include, for example depending on the desired particle size, a material selected from channel black, furnace black, acetylene black, Ketchen black, thermal black, and other carbon black. For example, furnace black may be used as the carbon black.

In the present invention, in order to impart a predetermined light blocking effect to the fiber structure containing polyetherimide-based fibers, the polyetherimide-based fiber needs to contain at least 0.03 wt % of carbon black therein.

Specifically, the addition amount of carbon black to the fiber (the carbon black content in the fiber) is preferably from 0.03 wt % to 0.7 wt % from the viewpoint of contribution of the fiber for light blocking effect to the fiber structure as well as inhibition of outgassing from the fibers. The addition amount is more preferably from 0.1 wt % to 0.6 wt %, and still more preferably 0.1 wt % to 0.4 wt %.

The number-mean particle size of primary particles (primary particle number-mean particle size) of the carbon black used in the present invention is within a range of from 30 nm to 500 nm. The number-mean particle size of primary particles (primary particle number-mean particle size) of the carbon black is more preferably within a range of from 40 nm to 300 nm. Where the carbon black has a primary particle number-mean particle size of less than 30 nm, the outgassing amount increases due to enlarged specific surface area of the particles. Where the carbon black has a primary particle number-mean particle size of larger than 500 nm, it is necessary for fibers to contain a comparatively large amount of carbon black in order to impart a desired light blocking effect to a fiber structure, so that there is a possibility that outgassing amount may increase. It should be noted that since carbon black with various kinds of number mean particle sizes are available from the market, carbon black can be selected from these material for usage.

It is preferred to control the content of carbon black along with the particle size, even in the range described above. Since the carbon black with comparatively small particle size has larger specific surface area to increase outgassing amount around the glass transition point of a polyetherimide resin, it is preferable to decrease the addition amount of carbon black. On the other hand, the carbon black with a comparatively large particle size needs to be added in a comparatively larger addition amount in order to give a desired light blocking effect to the fiber structure.

From the above-mentioned viewpoint, it is preferable that the carbon black satisfies a ratio D/A of 80 or more, where "D" denotes primary particle number-mean particle size of the carbon black as "D nanometer" and "A" denotes the content of carbon black in the fiber as "A wt %". The ratio D/A is more preferably 100 to 2000, and still more preferably 400 to 1000.

Production Method of Polyetherimide-Based Fiber

In the production of a polyetherimide-based fiber, a resin (matrix resin) containing a polyetherimide is fused, for example at a temperature of from 340° C. to 400° C., and then carbon black is added and kneaded to the resin so as to form a carbon black-pigmented resin in which carbon black is dispersed in the resin. Powdery carbon black may be added to the resin in a molten state. It is also possible to use a carbon black-containing resin (masterbatch) prepared beforehand. In this case, the matrix resin in the carbon black-pigmented resin includes a first polyetherimide resin containing a polyetherimide and a second polyetherimide resin that constitutes the masterbatch. The first polyetherimide resin may be different from the second polyetherimide resin, but it is preferred that first polyetherimide resin and the second polyetherimide resin may contain the same component. Thus-obtained carbon black-containing resin is subjected to melt-spinning to form a fiber, so that the polyetherimide-based fiber of the present invention can be produced. Although the melt-spinning temperature depends on the melting point of the polyetherimide resin, the melt-spinning temperature may be in a range, for example from 340° C. to 430° C., preferably 340° C. to 410° C., and more preferably 340° C. to 400° C.

Spinnability of the resin is dependent on particle size of carbon black added in the resin as well as the addition amount of the carbon black. In order to secure a good spinnability, the carbon black preferably has a primary particle number-mean particle size of from 30 nm to 500 nm. In particular, where the carbon black has a particle size exceeding 500 nm as a primary particle number-mean particle size, spinnability will be remarkably deteriorated. Furthermore, in order to secure a good spinnability, the addition amount of carbon black in the fiber is still more preferably 0.7 wt % or less.

Upon melt-spinning of the polyetherimide-based fiber, known melt-spinning apparatuses can be used for producing the fiber. For example, pellets of a polyetherimide resin as well as a masterbatch are melt-kneaded by using a melt extruder to obtain the molten polymer having a predetermined melt viscosity, and then the molten polymer is fed to a spinning tube. The molten polymer is metered by a gear pump to discharge a predetermined amount from the spinning nozzle, and the discharged yarn is wound up to produce a polyetherimide-based fiber of the present invention.

For example, in the case of melt-spinning, the resin may be discharged from a nozzle (spinneret) with a single hole size (single hole) of from 0.1 mm to 10.0 mm to form a fiber shape. The discharged fibers are wound at a winding rate of from 500 m/min. to 4000 m/min., preferably from 1000 m/min. to 3000 m/min., so that fibers containing carbon black at a specific content can be obtained. The fiber may be used in the undrawn state as an as-spun yarn. If necessary, for example in the case of obtaining the fiber from a crystalline polyetherimide resin, the wound fibers may be subjected to drawing treatment. Alternatively, where the fibers are used for fiber structures, such as a flocked fiber article and a paper material, fibers discharged from the spinneret may be directly used without being wound. The fiber may have a circular cross-sectional shape, or have other cross-sectional shapes (non-circular cross-sectional shape).

Polyetherimide-Based Fiber

As described above, the polyetherimide-based fiber can be obtained by dispersing carbon black in a polyetherimide resin, and spinning the carbon black-dispersed resin.

The polyetherimide-based fiber according to the present invention has a controlled weight reduction rate of less than 0.5% around the glass transition point temperature (Tg) of the polyetherimide resin as defined by the following formula (1).

$$\text{Weight reduction rate (\%)} = \{[(\text{fiber weight at temperature } T1) - (\text{fiber weight at temperature } T2)]/(\text{fiber weight at temperature } T1)\} \times 100 \quad (1)$$

Where T1 denotes a temperature (Tg−15° C.) that is 15° C. lower than the glass transition point (glass transition temperature) of the polyetherimide resin, and T2 denotes a temperature (Tg+25° C.) that is 25° C. higher than the glass transition point.

The weight reduction rate is determined using thermogravimetric/differential thermal analysis system (TG-DTA) as for a sample containing a certain amount of polyetherimide-based fibers, by measuring a fiber weight at a temperature (Tg−15° C.) that is 15° C. lower than the glass transition point of the polyetherimide resin, and a fiber weight at a temperature (Tg+25° C.) that is 25° C. higher than the glass transition point of the polyetherimide resin. It is presumed that the weight reduction rate of the fiber reflects the outgassing amount, i.e., the lower the weight reduction rate is, the less outgassing amount is. Where a molded product is produced from fibers by thermoforming, the fibers are heated to the temperature around the glass transition point of the resin at which the resin gains mobility. Accordingly, it is not preferable for a molded product to use fibers causing significant outgassing in a temperature range around the glass transition point of the resin at which the resin gains mobility, because such fibers make the molded product to be shrunk, as well as cause crack on the surface(s) of the molded product or the fibers.

For example, the polyetherimide-based fiber according to the present invention may have a shrinkage percentage under dry heat at 200° C. (shrinkage percentage at the time of holding fibers for 10 minutes at 200° C.) of 5.0% or less, and preferably of −1.0% to 5.0%.

Further, the polyetherimide-based fiber according to the present invention may have a limiting oxygen index value (LOI value) of 25 or greater, preferably of 28 or greater, and more preferably of 30 or greater. Although it is desirable for fibers to have an LOI value as high as possible, the LOI value is 40 or less in many cases. It should be noted that the LOI value here is a value measured by the method in Examples described below.

The fineness of the polyetherimide-based fiber is not limited to a specific one, and for example, a single fiber fineness (fineness of monofilament) can be selected from the range of 0.1 dtex to 1000 dtex suitably depending on a use. For example, where fibers are used for a fabric, a single fiber fineness may be 1 dtex to 10 dtex, or may be 1 dtex to 5 dtex. Depending on a use, the polyetherimide-based fiber may be a monofilament and may be a multifilament.

The polyetherimide-based fiber according to the present invention preferably has a tenacity at room temperature of 1.0 cN/dtex or greater, for example, 1.0 to 10 cN/dtex, and more preferably 2.0 eN/dtex or greater. It should be noted that the tenacity (tensile strength) is a value measured based on the JIS L 1013.

Fiber Structure

The fiber structure containing the polyetherimide-based fibers according to the present invention is not limited to a specific one regarding its shape or configuration. For example, the fiber structure may be a flocked fiber article (fiber mat), a sheet-shaped fiber structure such as fabrics (for example, a woven or knitted fabric and a nonwoven fabric) and papers, and an aggregate of powdery fibers obtained by shredding the fibers according to the present invention. A fiber structure may include other fire retardant fibers in addition to the polyetherimide-based fiber according to the present invention. For example, a fabric and a flocked fiber article may be formed from a mixture of the polyetherimide-based fibers according to the present invention and additional fibers other than the polyetherimide-based fibers. The fiber structure may be a layered product containing one or more layers each containing the polyetherimide-based fibers according to the present invention, and, if necessary, one or more layers containing additional fibers.

Where the fiber structure is a sheet-shaped material (for example, a fabric), the fiber structure may contain the polyetherimide-based fibers in the proportion of 30 wt % or greater, preferably 50 wt % or greater, and more preferably 70 wt % or greater, as a monolayer or as a whole in a plurality of layers. The sheet-shaped fiber structure preferably contains carbon black at an amount of at least 0.2 $g/m^2$ or greater, more preferably from 0.2 $g/m^2$ to 7.0 $g/m^2$, still more preferably from 0.27 $g/m^2$ to 7.0 $g/m^2$, and especially preferably from 0.5 $g/m^2$ to 5.0 $g/m^2$.

The fiber structure may have any basis weight as long as the fiber structure gains desired light blocking effect, and may have, for example, a basis weight of preferably 3000 $g/m^2$ or less, more preferably 2000 $g/m^2$ or less, still more preferably 1000 $g/m^2$ or less, and especially preferably 750 $g/m^2$ or less. The basis weight of a fiber structure preferably exceeds 150 $g/m^2$, and is more preferably 300 $g/m^2$ or more, and still more preferably 450 $g/m^2$ or more. Where the basis weight exceeds 3000 $g/m^2$, the fiber structure may be deteriorated in fabrication or molding property. Where the basis weight is 150 $g/m^2$ or less, the fiber structure may have a reduced strength.

Where the fiber structure is a sheet-shaped material of a monolayer or a multilayer, thickness of the fiber structure, as thickness of the monolayer or the total thickness of the multilayer, is preferably 1 mm or thicker, for example, 3 mm to 10 mm.

After fabricating the above-mentioned fiber structure (for example, fabrics, such as a nonwoven fabric), if necessary with other materials, to a specified shape, a part of or all of the polyetherimide-based fibers may be fused to form a shaped or molded article. Such a formed article has fire retardancy due to polyetherimide resin, as well as has light blocking effect imparted by the carbon black that is dispersed.

EXAMPLES

Hereinafter, the present invention will be demonstrated by way of some examples that are presented only for the sake of illustration, which are not to be construed as limiting the scope of the present invention. It should be noted that in the following Examples, fiber properties were evaluated in the following manners.

Weight Reduction Rate

The weight reduction rate of the polyetherimide-based fiber around the glass transition point was determined using thermogravimetric/differential thermal analysis system (TG-DTA) as for a sample containing a certain amount of polyetherimide-based fibers, by measuring a fiber weight at a temperature (Tg−15° C.) that is 15° C. lower than the glass transition point of the polyetherimide resin, and a fiber weight at a temperature (Tg+25° C.) that is 25° C. higher than the glass transition point of the polyetherimide resin, and calculated in accordance with the following formula (1).

$$\text{Weight reduction rate (\%)}=\{[(\text{fiber weight at temperature } T1)-(\text{fiber weight at temperature } T2)]/(\text{fiber weight at temperature } T1)\}\times 100 \quad (1)$$

Primary Particle Number-Mean Particle Size of Carbon Black

In Examples, commercial products of carbon black, each having a predetermined number mean particle size, were used. The number mean particle size of the commercial products was measured using a dynamic-light-scattering method, laser diffractometry, and the like. It should be noted that the number mean particle size of carbon black in a fiber is obtained by observing a fiber section using the field emission type scanning electron microscope.

Molecular Weight

The molecular weight distribution of each sample was measured by using the gel permeation chromatography (GPC) available from Waters Corporation with 1500 ALC/GPC (polystyrene conversion). After dissolving each of the samples in chloroform as a solvent to a concentration of 0.2 mass %, the solution was filtered and measured.

Fiber Fineness (dtex)

Fiber fineness (dtex) was measured in accordance with JIS L 1013.

Spinnability

In the process of spinning and fiber-forming from 100 kg of polymer, the number of fiber breaking times during the process was estimated as follows: A: 3 times or less/100 kg, B: 4 to 7 times/100 kg, and C: 8 times or more/100 kg.

Basis Weight ($g/m^2$)

Basis weight was measured in accordance with JIS L 1913. The average of 3 samples (n=3) was adopted.

Glass Transition Temperature (° C.)

Glass transition temperature of a resin was determined using "TA3000-DSC" available from Mettler from an inflection point observed during elevated heating at the heating rate of 10° C./min until 400° C. under nitrogen atmosphere.

Limiting Oxygen Index Value (LOI Value)

Samples each tied into a braid and having a length of 18 cm were prepared. According to JIS K7201-2, after igniting the upper portion of the samples, the minimum oxygen concentration required for the samples to keep burning for at least 3 minutes or alternatively to be burned until the burning length of the sample became at least 5 cm was determined. The average of 3 samples (n=3) was adopted.

Example 1

A polyetherimide polymer ("ULTEM 9011" produced by SABIC Innovative Plastics Holding) was prepared. A masterbatch was also independently prepared. The masterbatch contained the same polyetherimide polymer above and 1 wt % of carbon black having a primary particle number-mean particle size of 40 nm. Into a single axis extruder, 90 parts by mass of the above-mentioned polyetherimide resin and 10 parts by mass of the masterbatch were fed and melt-kneaded with the screw at a temperature of 390° C., the molten polymer mixture was metered using a gear pump and discharged from the nozzle with holes (each hole: 0.3 mm in diameter); and then discharged filaments were wound at a winding rate of 1500 m/min to obtain polyetherimide-based fibers (2640 dtex/1200 f) containing 0.1 wt % of carbon black.

The polyetherimide resin used here was an amorphous polyetherimide resin, and had a weight-average molecular weight (Mw) of 32000 and a number average molecular weight (Mn) of 14500 (molecular weight distribution (Mw/Mn): 2.2). The spinnability and the LOI value were shown in Table 1.

The fibers of Example 1 had a tenacity (tensile strength) of 2.4 cN/dtex at room temperature in accordance with JIS L 1013.

Example 2

The same polyetherimide resin as Example 1 was prepared, and except for using a masterbatch containing carbon black having a mean particle size of the primary particles of 40 nm at a concentration of 5 wt %, the same procedure with Example 1 was carried out to obtain polyetherimide-based fibers (2640 dtex/1200 f) containing 0.5 wt % of carbon black. The spinnability and the LOT value were shown in Table 1.

Example 3

The same polyetherimide resin as Example 1 was prepared, and a masterbatch containing the same resin with above and 3 wt % of carbon black having a mean particle size of the primary particles of 300 nm was also independently prepared. Into a single axis extruder, 90 parts by mass of the above-mentioned polyetherimide resin and 10 parts by mass of the masterbatch were fed and melt-kneaded with the screw at a temperature of 390° C., the molten polymer mixture was metered using a gear pump and discharged from the nozzle with holes (each hole: 0.3 mm in diameter); and then discharged filaments were wound at a winding rate of 1500 in/min to obtain polyetherimide-based fibers (2640 dtex/1200 f) containing 0.3 wt % of carbon black. The spinnability and the LOI value were shown in Table 1.

Example 4

Except for using 80 parts by mass of the polyetherimide resin and 20 parts by mass of the masterbatch, in the same manner as Example 3, polyetherimide-based fibers (2640 dtex/1200 f) containing 0.6 wt % of carbon black were obtained. The spinnability was shown in Table 1.

Example 5

The same polyetherimide resin as Example 1 was prepared, and a masterbatch containing the same resin with above and 1 wt % of carbon black having a mean particle size of the primary particles of 100 nm was also independently prepared. Into a single axis extruder, 90 parts by mass of the above-mentioned polyetherimide resin and 10 parts by mass of the masterbatch were fed and melt-kneaded with the screw at a temperature of 390° C., the molten polymer mixture was metered using a gear pump and discharged from the nozzle with holes (each hole: 0.3 mm in diameter); and then discharged filaments were wound at a winding rate of 1500 m/min to obtain polyetherimide-based fibers (2640 dtex/1200 f) containing 0.1 wt % of carbon black. The spinnability was shown in Table 1.

Example 6

The same polyetherimide resin as Example 1 was prepared, and except for using a masterbatch containing carbon black having a mean particle size of the primary particles of 40 nm at a concentration of 0.3 wt %, the same procedure with Example 1 was carried out to obtain polyetherimide-based fibers (2640 dtex/1200 f) containing 0.03 wt % of carbon black. The spinnability was shown in Table 1.

Comparative Example 1

A polyetherimide polymer ("ULTEM 9011" produced by SABIC Innovative Plastics Holding) was prepared. A masterbatch was also independently prepared. The masterbatch contained the same polyetherimide polymer as above and 1 wt % of carbon black having a primary particle number-mean particle size of 27 nm. Into a single axis extruder, 90 parts by mass of the above-mentioned polyetherimide resin and 10 parts by mass of the masterbatch were fed and melt-kneaded with the screw at a temperature of 390° C. The molten polymer mixture was metered using a gear pump and discharged from the nozzle with holes (each hole: 0.3 mm in diameter); and then discharged filaments were wound at a winding rate of 1500 m/min to obtain polyetherimide-based fibers (2640 dtex/1200 f) containing 0.1 wt % of carbon black. The spinnability and the LOI value were shown in Table 1.

Comparative Example 2

Into a single axis extruder, 90 parts by mass of the polyetherimide resin used in Example 1 were fed and melt-kneaded with the screw at a temperature of 390° C. The molten polymer was metered using a gear pump and discharged from the nozzle with holes (each hole: 0.3 mm in diameter); and then discharged filaments were wound at a winding rate of 1500 m/min to obtain polyetherimide-based fibers (2640 dtex/1200 f) without carbon black. The spinnability and the LOI value were shown in Table 1.

Comparative Example 3

The same polyetherimide resin as Example 1 was prepared, and a masterbatch containing the same resin with above and 2 wt % of carbon black having a mean particle size of the primary particles of 600 nm was also independently prepared. Into a single axis extruder, 90 parts by mass of the above-mentioned polyetherimide resin and 10 parts by mass of the masterbatch were fed and melt-kneaded with the screw at a temperature of 390° C. The molten polymer mixture was metered using a gear pump and discharged from the nozzle with holes (each hole: 0.3 mm in diameter); and then discharged filaments were wound at a winding rate of 1500 m/min to obtain polyetherimide-based fibers (2640 dtex/1200 f) containing 0.2 wt % of carbon black. However, frequent fiber breakages were occurred during spinning. The spinnability was shown in Table 1. Although the fiber breakage was repeated, it was possible to acquire yarns at an amount usable as samples for measuring weight reduction rate.

Measurement of Weight Reduction Rate

Samples (10 mg) were obtained from the fibers of Example 1 to 6 and Comparative Examples 1 and 3, respectively. Each of the obtained samples was measured using a thermogravimetric/differential thermal analysis system (TG-DTA: Thermo Plus-2 produced by Rigaku Corporation) to determine weight reduction rate around the glass transition point of the polyetherimide resin. Since the glass transition point of the polyetherimide resin used in Examples was Tg=217° C., the weight reduction rate in each sample was measured by heating the sample fibers from T1=202° C. to T2=242° C.

The result of measurement is shown in Table 1.

TABLE 1

| | Carbon black | | Weight | | |
|---|---|---|---|---|---|
| | Number-mean particle size (nm) | Content in fiber (wt. %) | reduction rate (%) | Spinnability | LOI value |
| Ex. 1 | 40 | 0.1 | 0.234 | A | 33 |
| Ex. 2 | 40 | 0.5 | 0.406 | A | 33 |
| Ex. 3 | 300 | 0.3 | 0.000 | A | 34 |
| Ex. 4 | 300 | 0.6 | 0.204 | B | — |
| Ex. 5 | 100 | 0.1 | 0.094 | A | — |
| Ex. 6 | 40 | 0.03 | 0.078 | A | — |
| Com. Ex. 1 | 27 | 0.1 | 0.736 | A | 33 |
| Com. Ex. 2 | — | 0.0 | — | A | 34 |
| Com. Ex. 3 | 600 | 0.2 | 0.012 | C | — |

As shown in the results in Table 1, Examples 1 to 6 each containing carbon black having a particle size and an addition amount within the scope of the present invention have a low weight reduction rate when heating the sample from the temperature lower than the Tg to the temperature higher than the Tg. These results reveal that gas generation which causes weight reduction of the polyetherimide-based fiber is inhibited. Comparison between Examples 1 and 2 as well as comparison between Examples 3 and 4 reveal that where the particle size of carbon black is same, greater content of carbon black causes higher weight reduction rate due to outgassing. Comparison between Examples 1 and 3 as well as comparison between Examples 2 and 4 reveal that where carbon black has larger particle size, Examples with carbon black having larger particle size inhibit weight reduction rates due to outgassing compared to Examples with carbon black having smaller particle size. On the other hand, Comparative Example 1 has a large weight reduction rate, so that outgassing is not inhibited. It is considered that the large weight reduction is attributed to the particle size of the carbon black. Although in Comparative Example 3 fibers containing carbon black having the large mean particle size have a reduced weight reduction rate, since the spinnability of the fibers is not satisfactory, it is considered that the fiber is unsuitable as the material of a fiber structure. Comparison between Examples and Comparative Examples revealed that no correlation was not observed between the LOI value and the content of carbon black.

Nonwoven Fabric

Example 7

After crimping the fibers obtained in Example 1, the fibers were cut to give short cut fibers (fiber length: 76 mm). These short cut fibers were subjected to carding to obtain a fiber web with a basis weight of 150 g/m$^2$. Subsequently, six sheets of the fiber web were piled up, and a nonwoven fabric of Example 7 was obtained using needle punch method. The carbon black content of this nonwoven fabric is calculated as 0.90 g/m$^2$ from the carbon black content in the material fibers and the basis weight of 900 g/m$^2$.

Comparative Example 4

From the fibers obtained in Comparative Example 2 as raw material, a nonwoven fabric of Comparative Example 4 (basis weight: 900 g/m$^2$) was produced in the same method as Example 7.

Example 8

After crimping the fibers obtained in Example 1, and the polyetherimide-based fibers prepared in Comparative Example 2, these fibers were cut to short cut fibers (fiber length: 76 mm). These short cut fibers were mixed in the mass ratio of (the fibers obtained in Example 1):(the polyetherimide-based fibers obtained in Comparative Example 2)=50:50, and a nonwoven fabric of Example 8 was produced from the fiber mixture in accordance with the method in Example 7. The carbon black content of this nonwoven fabric is calculated as 0.45 g/m$^2$ from the carbon black content in the material fibers and the basis weight of 900 g/m$^2$. It should be noted that a nonwoven fabric produced from 100 parts by mass of the polyetherimide-based fibers containing 0.05% of carbon black is presumed to have the light blocking effect equivalent to the nonwoven fabric of Example 8 because the content of carbon black in the nonwoven fabric is the same with that in Example 8.

Example 9

After crimping the fibers obtained in Example 1 as well as the polyetherimide-based fibers obtained in Comparative Example 2, these fibers were cut to short cut fibers (fiber length: 76 mm). These short cut fibers were mixed in the mass ratio of (the fibers obtained in Example 1):(the polyetherimide-based fibers obtained in Comparative Example 2)=30:70, and a nonwoven fabric of Example 9 was produced from the fiber mixture in accordance with the method in Example 7. The carbon black content of this nonwoven fabric is calculated as 0.27 g/m$^2$ from the carbon black content in the material fibers and the basis weight of 900 g/m$^2$. It should be noted that a nonwoven fabric produced from 100 parts by mass of the polyetherimide-based fibers containing 0.03% of carbon black is presumed to have the light blocking effect equivalent to the nonwoven fabric of Example 9 because the content of carbon black in the nonwoven fabric is the same with that in Example 9.

Example 10

After crimping the fibers obtained in Example 4, the fibers were cut to give short cut fibers (fiber length: 76 mm). These short cut fibers were subjected to carding to obtain a fiber web with a basis weight of 150 g/m$^2$. Subsequently, six sheets of the fiber web were piled up, and a nonwoven fabric of Example 10 was obtained using needle punch method. The carbon black content of this nonwoven fabric is calculated as 5.4 g/m$^2$ from the carbon black content in the material fibers and the basis weight of 900 g/m$^2$.

Comparative Example 5

After crimping the fibers obtained in Example 1 as well as the polyetherimide-based fibers prepared in Comparative Example 2, these fibers were cut to short cut fibers (fiber length: 76 mm). These short cut fibers were mixed in the mass ratio of (the fibers obtained in Example 1):(the polyetherimide-based fibers obtained in Comparative Example 2)=10:90, and a nonwoven fabric of Comparative Example 5 was produced from the fiber mixture in accordance with the method in Example 7. The carbon black content of this nonwoven fabric is calculated as 0.09 g/m$^2$ from the carbon black content in the material fibers and the basis weight of 900 g/m$^2$. It should be noted that a nonwoven fabric produced from 100 parts by mass of the polyetherimide-based fibers containing 0.01% of carbon black is presumed to have the light blocking effect equivalent to the nonwoven fabric of Comparative Example 5 because the content of carbon black in the nonwoven fabric is the same with that in Comparative Example 5.

Example 11

After crimping the fibers obtained in Example 4, the fibers were cut to give short cut fibers (fiber length: 76 mm). These short cut fibers were subjected to carding to obtain a fiber web with a basis weight of 150 g/m$^2$. Subsequently, seven sheets of the fiber web were piled up, and a nonwoven fabric of Example 11 was obtained using needle punch method. The carbon black content of this nonwoven fabric is calculated as 6.3 g/m$^2$ from the carbon black content in the material fibers and the basis weight of 1050 g/m$^2$.

Comparative Example 6

After crimping the fibers obtained in Example 1, the fibers were cut to give short cut fibers (fiber length: 76 mm). These short cut fibers were subjected to carding to obtain a fiber web with a basis weight of 150 g/m$^2$. This web was used as a nonwoven fabric of Comparative Example 6.

Light Blocking Effect Evaluation Test

As a light source mimicking sunlight that has illumination of 32 to 100 kLx, color temperature of 2000 K for every morning and evening, and 5000 to 6000 K for daytime, a lamp (MHF-G150LR produced by MORITEX) with an illumination of 80 kLx and a color temperature of 3400 K was prepared, and the lamp was placed as a light source, so that light was irradiated to each of the nonwoven fabrics of Examples 7 to 11 and Comparative Examples 4 to 6 at a distance of about 1.5 cm from the nonwoven fabric. The digital camera was also placed at a distance of about 10 cm from the nonwoven fabric at the opposite side of the light source to take photos of the nonwoven fabric. The photographed field had a size about 12 cm×12 cm square. Samples were determined as being rejected where the position of the light source was recognized, and as being accepted where the position of the light source was not recognized. Some parts of photos are shown in FIGS. 1 to 5, and the evaluation results are shown in Table 2. The photos of the nonwoven fabrics obtained in Examples 7, 8, 9 and Comparative Examples 4 and 5 are shown in FIGS. 1 to 5, respectively.

TABLE 2

| | Carbon black content (g/m$^2$) | Determination | Basis weight (g/m$^2$) |
|---|---|---|---|
| Ex. 7 | 0.90 | Accepted | 900 |
| Ex. 8 | 0.45 | Accepted | 900 |
| Ex. 9 | 0.27 | Accepted | 900 |
| Ex. 10 | 5.40 | Accepted | 900 |
| Ex. 11 | 6.30 | Accepted | 1050 |
| Com. Ex. 4 | 0 | Rejected | 900 |
| Com. Ex. 5 | 0.09 | Rejected | 900 |
| Com. Ex. 6 | 0.15 | Rejected | 150 |

Figure 2:
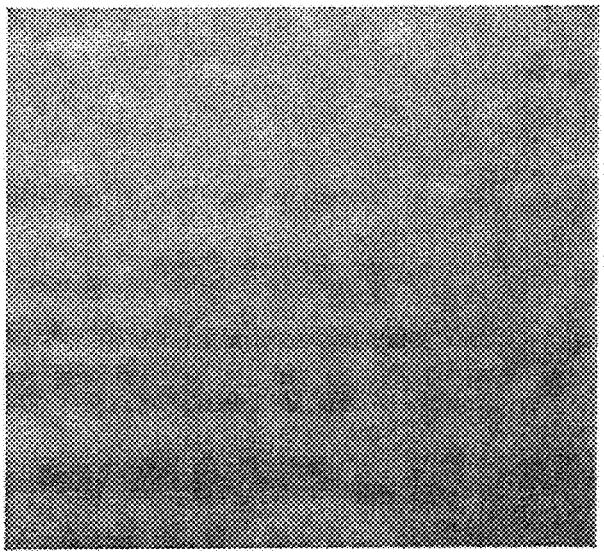
FIG. 2 is a photograph used for the light blocking effect evaluation test of the fabric obtained in Example 8 according to the present invention.
Figure 3:
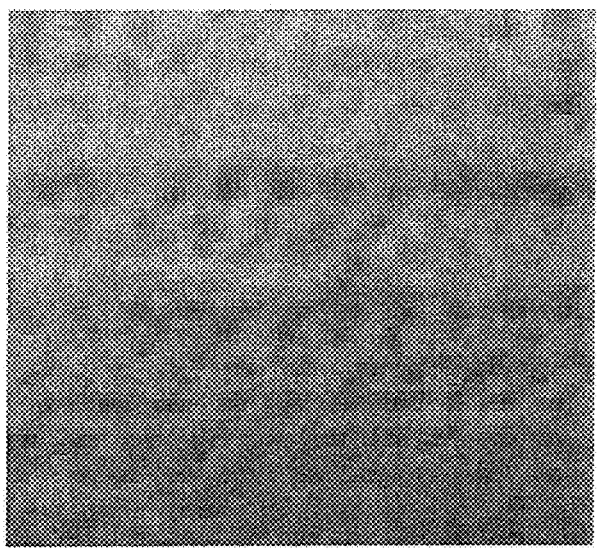
FIG. 3 is a photograph used for the light blocking effect evaluation test of the fabric obtained in Example 9 according to the present invention.
Figure 4:
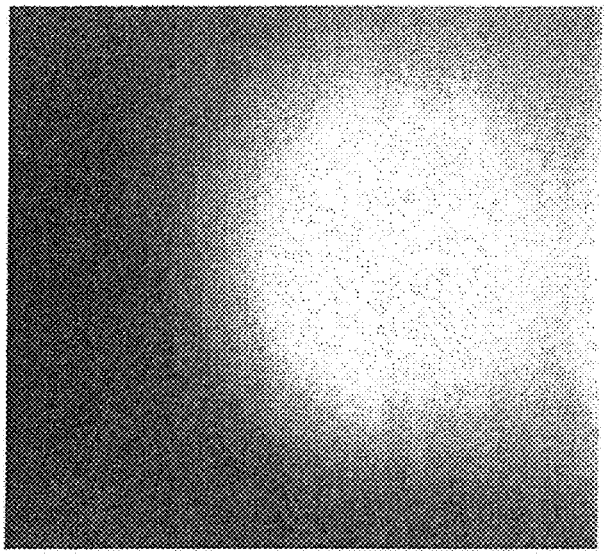
FIG. 4 is a photograph used for the light blocking effect evaluation test of the fabric obtained in Comparative Example 4.
Figure 5:
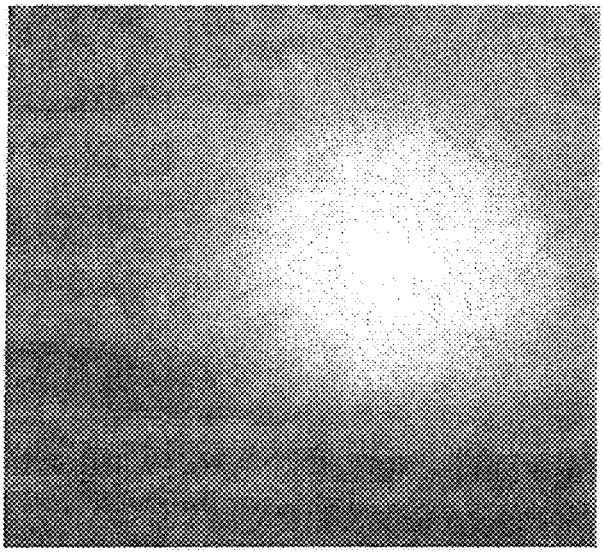
FIG. 5 is a photograph used for the light blocking effect evaluation test of the fabric obtained in Comparative Example 5.

The results in Table 2 reveal that the nonwoven fabrics of Examples 7 to 11, each of which contains carbon black within the scope of the present invention, show good light blocking effect to the sunlight-mimicking light as shown also in FIGS. 1 to 3. The results also reveal that the nonwoven fabric of Comparative Example 4 which does not contain carbon black, and the nonwoven fabric of Comparative Example 5 which contains only small amount of carbon black have insufficient light blocking effect as shown in FIGS. 4 and 5, respectively, each showing that the projecting light source is recognized according to the transmitted light. Further, from the results of Example 9 and Comparative Example 5, it can be presumed that good light blocking effect can be achieved not only as for nonwoven fabrics containing equal to or more than 0.27 g/m$^2$ of carbon black but also as for fibers containing equal to or more than 0.03 wt % of carbon black. The nonwoven web of Comparative Example 6 having a basis weight of 150 g/m$^2$ was not only insufficient in light blocking effect, but also had reduced strength, resulting in difficulty in handleability.

INDUSTRIAL APPLICABILITY

According to the present invention, there is a provision of a polyetherimide-based fiber that can impart a certain light blocking effect to fiber structures, such as a fabric and a fiber mat, as well as can reduce gas generation under high temperature. The fiber structure formed from such fibers can be safely used as industrial materials, various interior materials, and as other materials in the applications requiring fire retardancy, for example, in ordinary houses, various establishments, such as hospitals, schools, and accommodations, in a closed space, such as a transportation means or vehicles.

What is claimed is:

1. A polyetherimide-based fiber containing a polyetherimide resin and carbon black dispersed in the resin, wherein the fiber has a content of the carbon black of from 0.03 wt % to 0.4 wt %; the carbon black has a primary particle number-mean particle size of from 30 nm to 500 nm; the fiber has a weight reduction rate of less than 0.5% around the glass transition point (Tg) of the polyetherimide resin, where the weight reduction rate is defined by the following formula (1):

$$\text{weight reduction rate (\%)}=\{[(\text{fiber weight at temperature } T1)-(\text{fiber weight at temperature } T2)]/(\text{fiber weight at temperature } T1)\}\times 100 \quad (1)$$

where T1 denotes a temperature (Tg−15° C.) that is 15° C. lower than the glass transition point (glass transition temperature) of the polyetherimide resin, and T2 denotes a temperature (Tg+25° C.) that is 25° C. higher than the glass transition point, wherein the weight reduction rate is determined by a thermogravimetric/differential thermal analysis system (TG-DTA), the glass transition point (Tg) is determined by differential scanning calorimetry (DSC), and the carbon black satisfies a ratio D/A of 100 or more, where "D" denotes primary particle number-mean particle size of the carbon black as "D nanometer" and "A" denotes the content of carbon black in the fiber as "A wt %".

2. The polyetherimide-based fiber according to claim 1, wherein the carbon black satisfies the ratio D/A of 400 or more.

3. A fiber structure containing a polyetherimide-based fiber recited in claim 1, wherein the fiber structure comprises a sheet-shaped material formed from a monolayer or a plurality of layers, contains equal to or more than 30 wt % of the polyetherimide-based fiber, and contains the carbon black at a content from 0.2 to 7.0 g/m$^2$.

4. The fiber structure according to claim 3, which has a form of a fabric.

5. A method for producing the polyetherimide-based fiber as recited in claim 1, the method comprising:

kneading carbon black into a polyetherimide resin to give a carbon black-kneaded resin, and melt-spinning the carbon black-kneaded resin to form a fiber.

6. The polyetherimide-based fiber according to claim 1, wherein a single fiber fineness of the polyetherimide-based fiber is from 0.1 dtex to 10 dtex.

* * * * *